US007090441B1

(12) United States Patent
Borgman et al.

(10) Patent No.: US 7,090,441 B1
(45) Date of Patent: Aug. 15, 2006

(54) INSULATION INSTALLATION SYSTEM

(75) Inventors: Roger L. Borgman, Norfolk, NE (US); Joseph C. Willingham, Sr., Elkin, NC (US); Mitchell R. Smith, Ronda, NC (US); Frank C. Burroughs, Waxhaw, NC (US)

(73) Assignee: U.S. Greenfiber, LLC, Charlotte, NC (US)

( * ) Notice: Subject to any disclaimer, the term of this patent is extended or adjusted under 35 U.S.C. 154(b) by 0 days.

(21) Appl. No.: 10/834,470

(22) Filed: Apr. 29, 2004

(51) Int. Cl.
*B65G 1/60* (2006.01)

(52) U.S. Cl. ..... 406/41; 406/43; 239/172; 239/651

(58) Field of Classification Search ..... 406/38, 406/39, 40, 41, 42, 43, 44, 122, 139, 144; 239/651, 653, 661, 663, 722
See application file for complete search history.

(56) References Cited

U.S. PATENT DOCUMENTS

| | | | | | |
|---|---|---|---|---|---|
| 1,681,877 | A * | 8/1928 | Pounds et al. | ..... | 406/39 |
| 2,311,773 | A * | 2/1943 | Patterson | ..... | 406/56 |
| 2,834,059 | A * | 5/1958 | Hoelzel | ..... | 406/196 |
| 3,995,775 | A * | 12/1976 | Birkmeier et al. | ..... | 406/96 |
| 4,129,338 | A * | 12/1978 | Mudgett | ..... | 406/135 |
| 4,717,289 | A * | 1/1988 | Popowich et al. | ..... | 406/122 |
| 4,773,960 | A * | 9/1988 | Vincelli et al. | ..... | 156/357 |
| 4,821,958 | A * | 4/1989 | Shaffer | ..... | 239/131 |
| 4,978,252 | A * | 12/1990 | Sperber | ..... | 406/64 |
| 5,114,281 | A * | 5/1992 | Hartnett et al. | ..... | 406/39 |
| 5,361,711 | A * | 11/1994 | Beyerl | ..... | 111/127 |
| 5,403,128 | A * | 4/1995 | Thomas | ..... | 406/39 |
| 5,590,984 | A * | 1/1997 | Assarsson | ..... | 406/32 |
| 5,725,160 | A * | 3/1998 | Harper et al. | ..... | 239/654 |
| 5,829,649 | A * | 11/1998 | Horton | ..... | 222/636 |
| 6,036,406 | A * | 3/2000 | Rexius | ..... | 406/39 |
| 6,089,795 | A * | 7/2000 | Booth | ..... | 406/43 |
| 6,109,488 | A * | 8/2000 | Horton | ..... | 222/636 |
| 6,161,784 | A * | 12/2000 | Horton | ..... | 239/654 |
| 6,343,897 | B1 * | 2/2002 | Cutler | ..... | 406/143 |
| 6,357,971 | B1 * | 3/2002 | Rexius | ..... | 406/43 |
| 6,425,529 | B1 * | 7/2002 | Reinsch et al. | ..... | 239/10 |
| 6,761,226 | B1 * | 7/2004 | Carrier et al. | ..... | 169/24 |
| 6,796,748 | B1 * | 9/2004 | Sperber | ..... | 406/123 |

* cited by examiner

*Primary Examiner*—Joe Dillon, Jr.
(74) *Attorney, Agent, or Firm*—MacCord Mason PLLC

(57) ABSTRACT

An insulation installation system including: a supply of material having discrete elements and a self-contained applicator. In the preferred embodiment of the invention, the insulation installation system further includes a work platform. The self-contained applicator includes a blower having an inlet and an outlet; a material feeder downstream from the blower; and an integrated electrical system adapted for household use. In the preferred embodiment of the invention, the self-contained applicator includes a vented air intake connected to the inlet of the blower.

56 Claims, 4 Drawing Sheets

14

INSULATION INSTALLATION SYSTEM

BACKGROUND OF THE INVENTION (1) Field of the Invention

The present invention relates generally to insulation systems and, more particularly, to an insulation system including a self-contained applicator system for installing a supply of material having discrete elements.

(2) Description of the Prior Art

Constructors including blown in insulation materials in a construction have typically been required to transport heavy equipment systems to a construction site to install the insulation. This equipment generally requires large vehicles and considerable labor to transport. Another drawback of such equipment is that it usually does not include an electrical system adapted for household use. Therefore, additional equipment is needed to supply electrical power for installing the insulation. Where large construction projects are concerned, such shortcomings may not be prohibitive. For small projects, however, installing blown in insulation materials may be impractical due to these considerations.

Thus, there remains a need for an insulation installation system including a supply of material having discrete elements; and a self-contained applicator including: a blower having an inlet and an outlet; a material feeder; and an integrated electrical system adapted for household use.

SUMMARY OF THE INVENTION

An insulation installation system including: a supply of material having discrete elements and a self-contained applicator. In the preferred embodiment of the invention, the insulation installation system further includes a work platform. The self-contained applicator includes a blower having an inlet and an outlet; a material feeder downstream from the blower; and an integrated electrical system adapted for household use. In the preferred embodiment of the invention, the self-contained applicator includes a vented air intake connected to the inlet of the blower.

In the preferred embodiment, integrated electrical system includes an electrical panel and at least one electrical breaker. The integrated electrical system further includes an integrated power cord non-removably attached to the electrical panel. The power cord may be a three-prong, single phase connector. The power cord may be sized for up to about 20 amps. The vented air intake may be positioned away from the material feeder for preventing loose supply material from being ingested by the blower.

In the preferred embodiment, the system may further include a crush resistant outlet hose. The crush resistant outlet hose may be selectable between a first discharge position and a second discharge position. The crush resistant outlet hose may be omni directional. The crush resistant outlet hose may be a swivel elbow.

In the preferred embodiment, the material feeder may further include a feed hopper for receiving the supply of material having discrete elements. The material feeder may further include a loading station adjacent to the feed hopper. The loading station may be a shelf. The shelf may further include a protective stop between the loading station and the feed hopper. The loading station may further include a barrier for preventing items from falling into the feed hopper. The loading station may further include a package slitter for opening the supply of material having discrete elements. The package slitter may be a utility knife. The utility knife may be a safety utility knife. The package slitter may further include a safety retainer for preventing the package slitter from falling into the feed hopper. The material feeder may further include a feed gate restrictor for limiting the feed rate the supply of material having discrete elements.

The work platform may be enclosed. The work platform may include at least two opposed side walls. At least one of the side walls may include at least one access door. The work platform may further include a front wall. The work platform may further include a back wall. The back wall may include at least one access door. The work platform may further include a top. The work platform may further include a trailer frame, a tongue, and at least one set of wheels attached to the trailer frame. The wheels may be positioned behind the center of gravity of the work platform. The tongue weight of the work platform may be about 60% of the total weight of the apparatus and the total gross vehicle weight of the apparatus may be less than about 3000 lbs. The apparatus may further include a hose storage rack.

In the preferred embodiment, the supply of material having discrete elements may be selected from the group consisting of fibrous material, granular material, pellet material and agglomerated material and mixtures thereof. The supply of material having discrete elements may be inorganic. The inorganic material may be selected from the group consisting of fiberglass, rock wool, pearlite, mineral wool, and asbestos and mixtures thereof. The supply of material having discrete elements may be organic. The organic material may be a natural material. The natural material may be cellulosic.

The supply of material having discrete elements may be a non-conductive material. The supply of non-conductive material may be a thermally non-conductive material. The supply of non-conductive material may be an acoustically non-conductive material. The supply of non-conductive material may be an electrically non-conductive material.

Accordingly, one aspect of the present invention is to provide an insulation installation system including: a supply of material having discrete elements; a self-contained applicator including: a blower having an inlet and an outlet; a material feeder; and an integrated electrical system adapted for household use.

Another aspect of the present invention is to provide a self-contained applicator for an insulation installation system for installing a supply of material having discrete elements including: a blower having an inlet and an outlet; a material feeder downstream from the blower; an integrated electrical system adapted for household use; and a vented air intake connected to the inlet of the blower.

Still another aspect of the present invention is to provide an insulation installation system comprising: a supply of material having discrete elements; a work platform; and a self-contained applicator, the self-contained applicator including: a blower having an inlet and an outlet; a material feeder downstream from the blower; an integrated electrical system adapted for household use; and a vented air intake connected to the inlet of the blower.

These and other aspects of the present invention will become apparent to those skilled in the art after a reading of the following description of the preferred embodiment when considered with the drawings.

DESCRIPTION OF THE PREFERRED EMBODIMENTS

Figure 1:
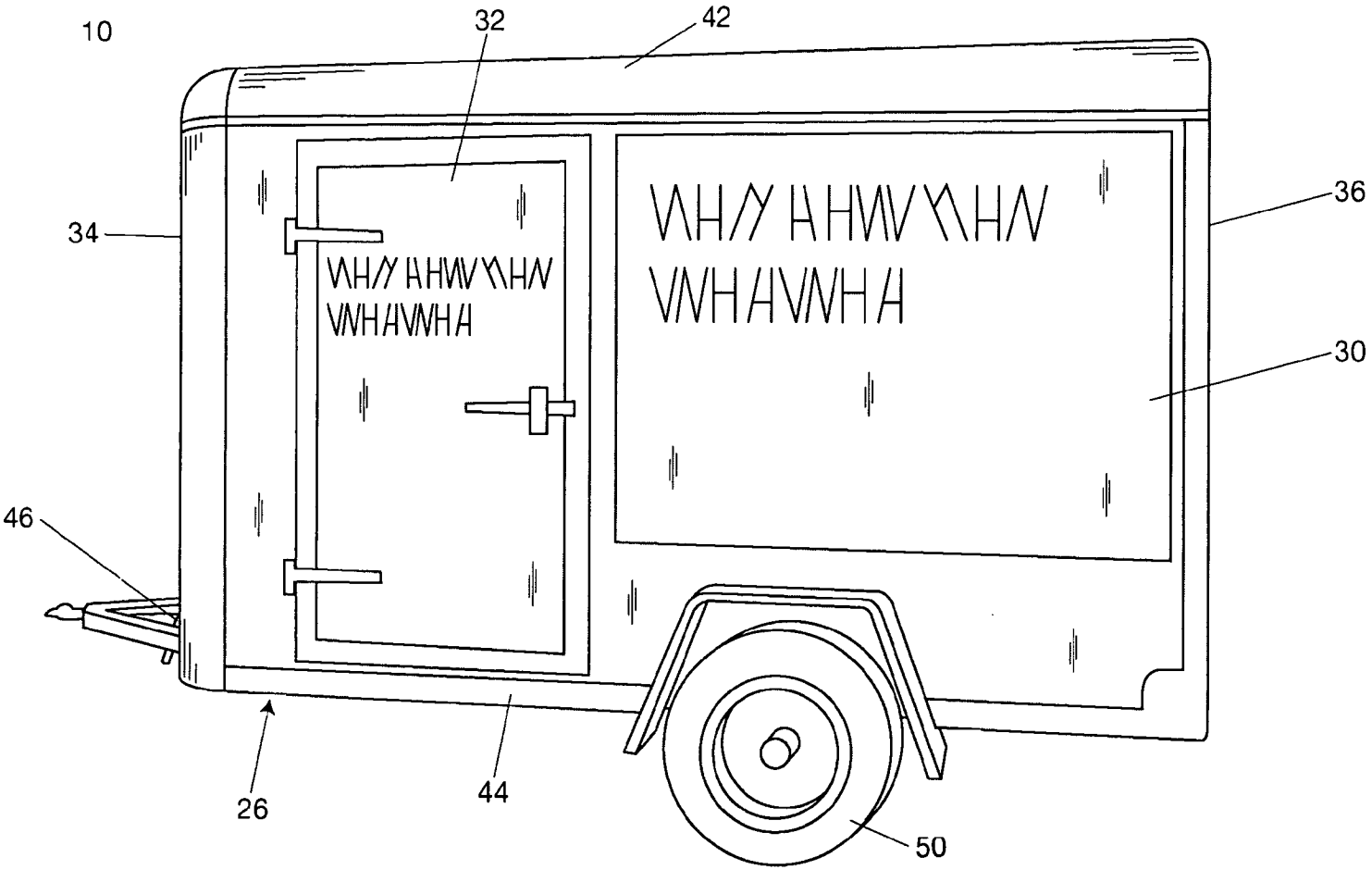
FIG. 1 is a side view of the outside of an insulation installation system constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. FIG. 1 is a side view of the outside of an insulation installation system, generally designated 10, constructed according to the present invention. The insulation installation system 10 includes a work platform 26, which includes a trailer frame 44, tongue 46, and a set of wheels 50 attached to the trailer frame 44. The work platform 26 is enclosed and includes at least two opposed side walls 30, a front wall 34, back wall 36, top 42, and at least one access door 32. The back wall 36 may also include at least one access door 32. The wheels 50 are positioned behind the center of gravity of the work platform 26. The tongue weight of the work platform is about sixty percent of the total weight of the insulation installation system 10 and the total gross vehicle weight of the apparatus is less than about three-thousand pounds.

Figure 2:
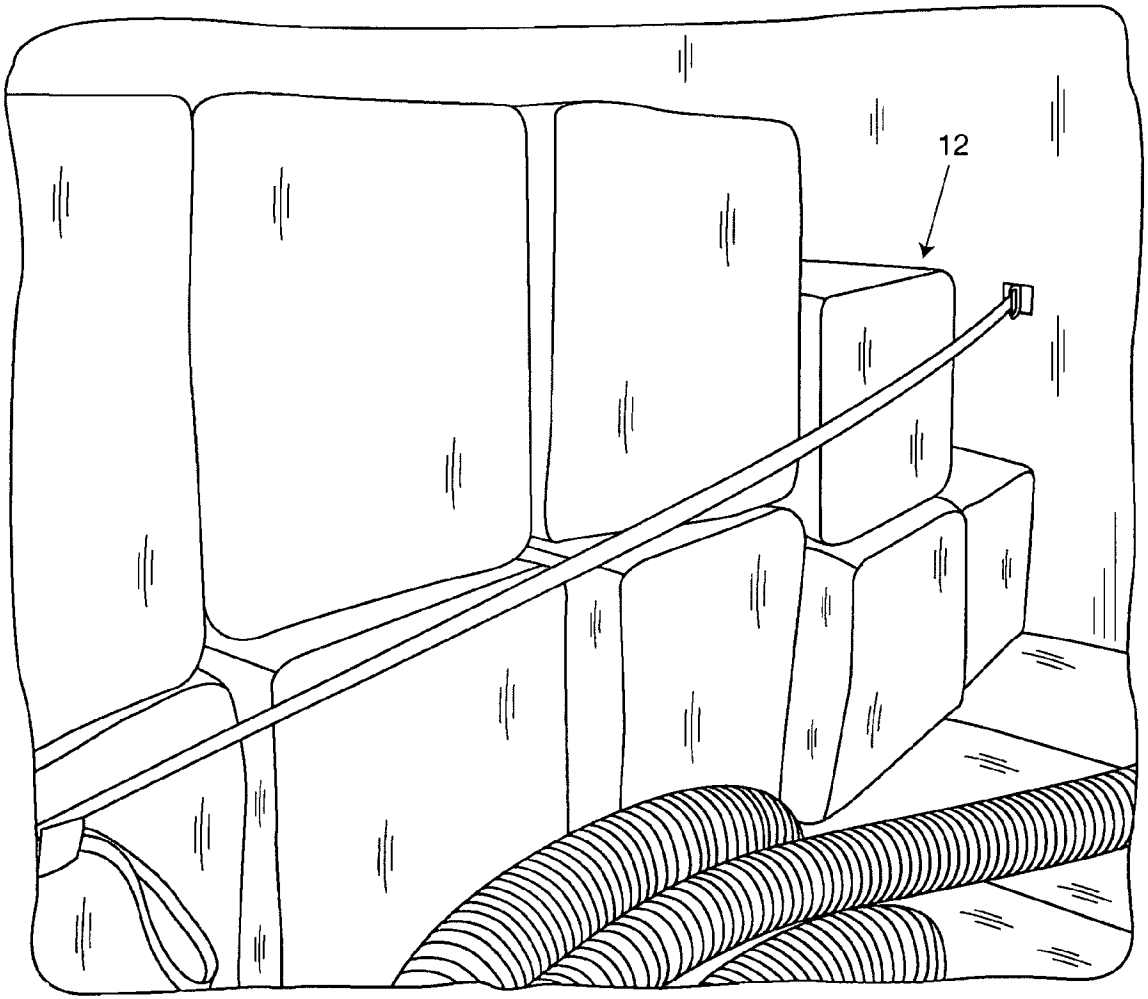
FIG. 2 is a front perspective view of the back of the inside of the insulation installation system showing a supply of material having discrete elements.

FIG. 2 is a front perspective view of the back of the inside of an insulation installation system showing a supply of material having discrete elements 12. The supply of material having discrete elements 12 may be selected from the group consisting of fibrous material, granular material, pellet material, and agglomerated material and mixtures thereof. The supply of material having discrete elements may be inorganic. The inorganic material may be selected from the group consisting of fiberglass, rock wool, pearlite, mineral wool, and asbestos and mixtures thereof. The supply of material having discrete elements may be organic. The organic material may be a natural material. The natural material may be cellulosic. The supply of material having discrete elements may be a non-conductive material. The non-conductive material may be a thermally non-conductive material. The supply of non-conductive material may be an acoustically non-conductive material. The supply of non-conductive material may be an electrically non-conductive material.

Figure 3:
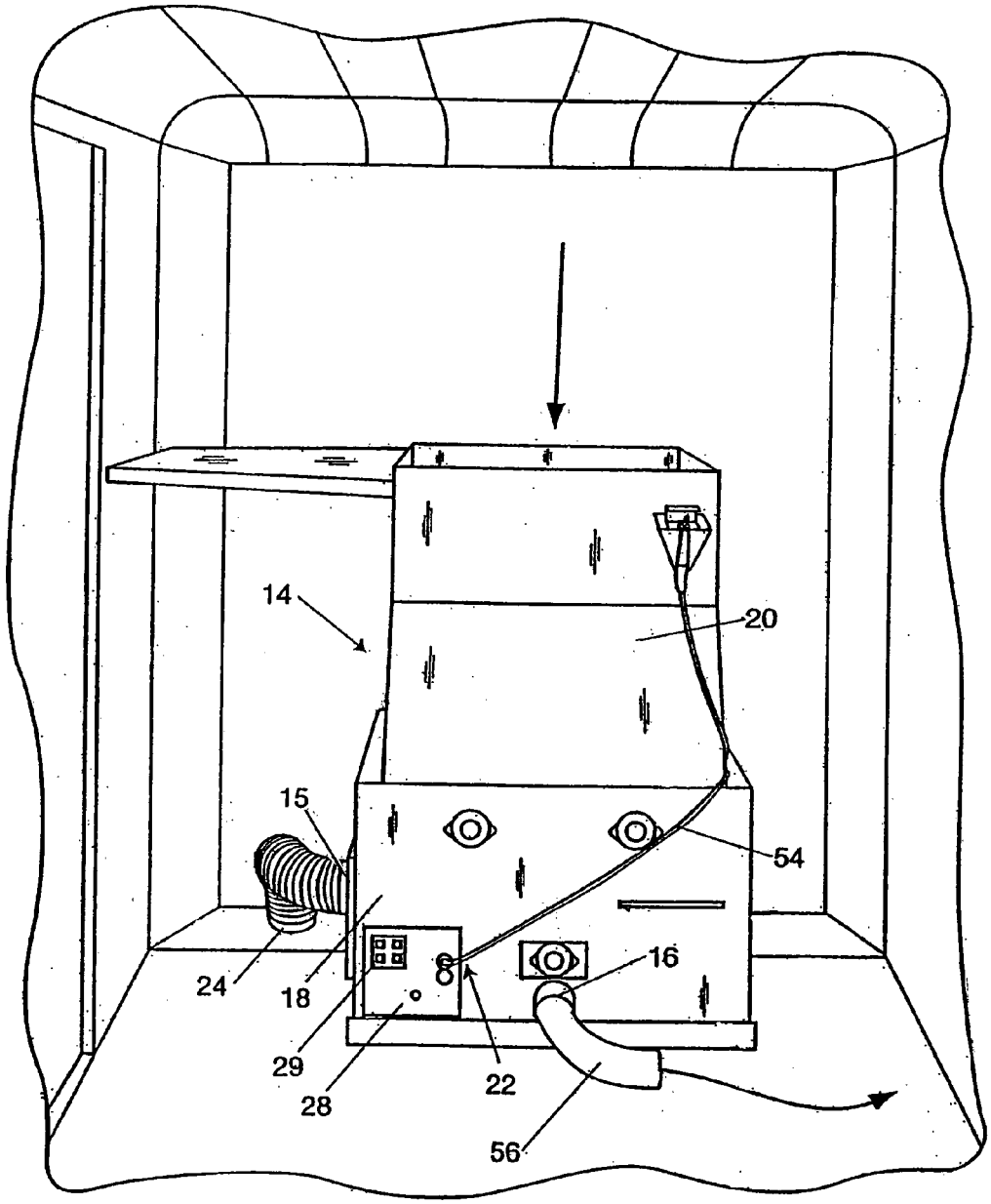
FIG. 3 is a rear perspective view of the inside of the insulation installation system showing a self-contained applicator.

FIG. 3 is a back perspective view of the inside of the insulation installation system showing a self-contained applicator 14. The self-contained applicator 14 includes a blower unit 18 having an inlet 15 and an outlet 16 a material feeder 20, and an integrated electrical system 22 adapted for household use. The integrated electrical system 22 includes an electrical panel 28, at least one electrical breaker 29, and an integrated power cord 54 non-removably attached to the electrical panel 28. The power cord is a three-prong, single-phase connector sized for up to about twenty amps. The self-contained applicator 14 also includes a vented air intake 24 connected to the inlet 15 of the blower unit 18. The vented air intake 24 is positioned away from the material feeder 20 for preventing loose supply material form being ingested by the blower unit 18. FIG. 3 also shows a crush-resistant outlet hose 56. The outlet hose is selectable between a first discharge position and a second discharge position. The outlet hose is an omni directional swivel elbow.

Figure 4:
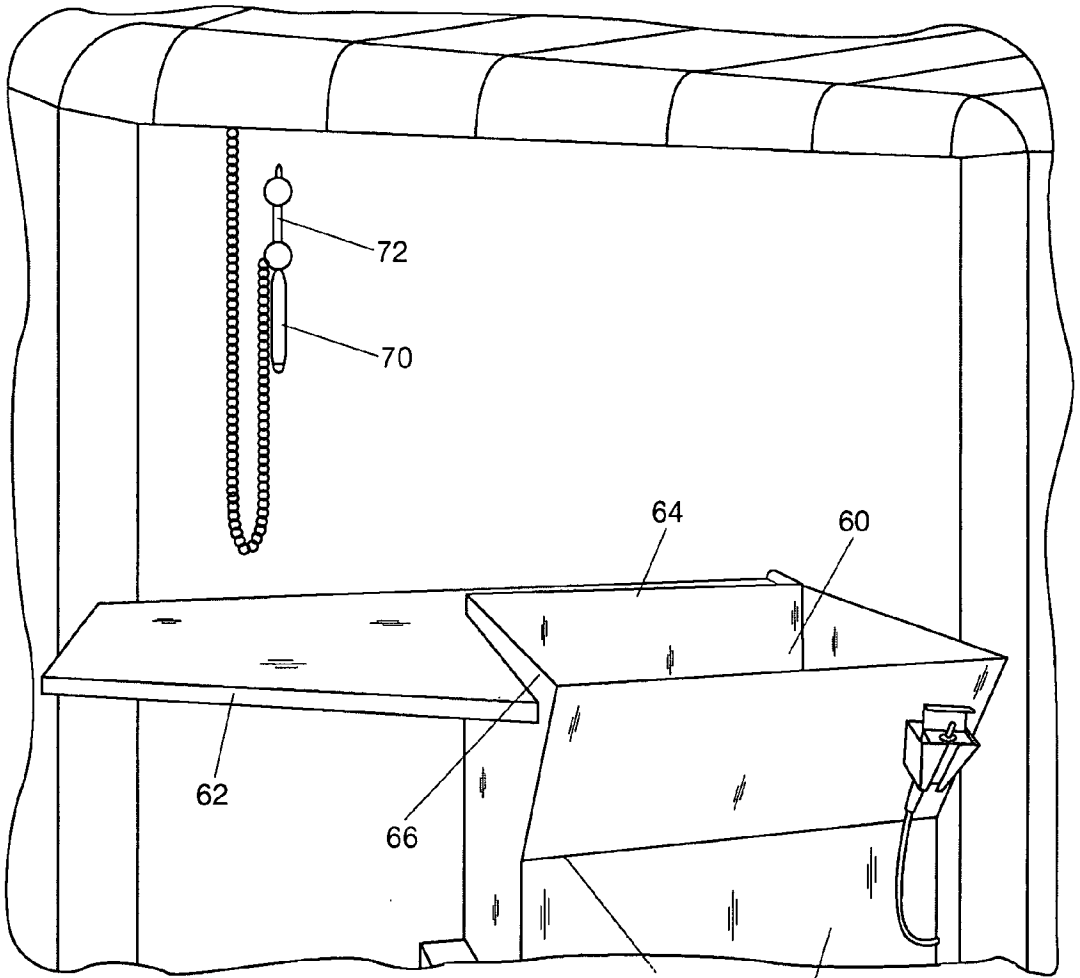
FIG. 4 is a rear perspective view of the inside of the insulation installation system showing a material feeder.

FIG. 4 is a rear perspective view of the inside of the insulation installation system showing the material feeder 20 including a material feed hopper 60 and a loading station 62 adjacent to the material feed hopper 62. The loading station 62 is a shelf. The shelf includes a protective stop 64 between the loading station 62 and the feed hopper 60. The loading station 62 also includes a barrier 66 for preventing items from falling into the feed hopper 60. The loading station 62 also includes a package slitter 70 for opening the supply of material having discrete elements. The package slitter 70 is a safety utility knife. The package slitter 70 includes a retainer 72 for preventing the package slitter 70 from falling into the feed hopper 60. The material feeder 20 includes a feed gate restrictor 74 for limiting the feed rate of the supply of material having discrete elements.

Certain modifications and improvements will occur to those skilled in the art upon a reading of the foregoing description. All such modifications and improvements have been deleted herein for the sake of conciseness and readability but are properly within the scope of the following claims.

We claim:

1. An insulation installation system comprising:

(a) a supply of material having discrete elements;

(b) a self-contained applicator for installing the supply of material, said self-contained applicator including: (i) a blower unit having an inlet and an outlet; (ii) a material feeder; and (iii) an integrated electrical system adapted for household use; and (c) a work platform including a trailer frame, a tongue, and at least one set of wheels attached to said trailer frame.

2. The system according to claim 1, wherein said work platform is enclosed.

3. The system according to claim 2, wherein said work platform includes at least two opposed side walls.

4. The system according to claim 3, wherein at least one of said side walls includes at least one access door.

5. The system according to claim 3, wherein said work platform further includes a front wall.

6. The system according to claim 3, wherein said work platform further includes a back wall.

7. The system according to claim 6, wherein said back wall includes at least one access door.

8. The system according to claim 3, wherein said work platform further includes a top.

9. The system according to claim 1, wherein said wheels are positioned behind the center of gravity of said work platform.

10. The system according to claim 9, wherein the tongue weight of said work platform is about 60% of the total weight of said apparatus and the total gross vehicle weight of said apparatus is less than about 3000 lbs.

11. The system according to claim 1, wherein said supply of material having discrete elements is selected from the group consisting of fibrous material, granular material, pellet material and agglomerated material and mixtures thereof.

12. The system according to claim 11, wherein the supply of material having discrete elements is inorganic.

13. The system according to claim 12, wherein said inorganic material is selected from the group consisting of fiberglass, rock wool, pearlite, mineral wool, and asbestos and mixtures thereof.

14. The system according to claim 11, wherein said supply of material having discrete elements is organic.

15. The system according to claim 14, wherein said organic material is a natural material.

16. The system according to claim 15, wherein said natural material is cellulosic.

17. The system according to claim 1, wherein said supply of material having discrete elements is a non-conductive material.

18. The system according to claim 17, wherein said supply of non-conductive material is a thermally non-conductive material.

19. The system according to claim 17, wherein said supply of non-conductive material is an acoustically non-conductive material.

20. The system according to claim 17, wherein said supply of non-conductive material is an electrically non-conductive material.

21. An insulation installation system comprising:

(a) a supply of material having discrete elements;

(b) a work platform including a trailer frame, a tongue, and at least one set of wheels attached to said trailer frame; and (c) a self-contained applicator for installing the supply of material including:

(i) a blower unit having an inlet and an outlet;

(ii) a material feeder for providing the supply of material to said blower unit;

(iii) an integrated electrical system adapted for household use; and (iv) a vented air intake connected to the inlet of said blower unit.

22. The system according to claim 21, wherein said work platform is enclosed.

23. The system according to claim 22, wherein said work platform includes at least two opposed side walls.

24. The system according to claim 23, wherein at least one of said side walls includes at least one access door.

25. The system according to claim 23, wherein said work platform further includes a front wall.

26. The system according to claim 23, wherein said work platform further includes a back wall.

27. The system according to claim 26, wherein said back wall includes at least one access door.

28. The system according to claim 23, wherein said work platform further includes a top.

29. The system according to claim 21, wherein said wheels are positioned behind the center of gravity of said work platform.

30. The system according to claim 29, wherein the tongue weight of said work platform is about 60% of the total weight of said apparatus and the total gross vehicle weight of said apparatus is less than about 3000 lbs.

31. The system according to claim 21, wherein said supply of material having discrete elements is selected from the group consisting of fibrous material, granular material, pellet material and agglomerated material and mixtures thereof.

32. The system according to claim 31, wherein the supply of material having discrete elements is inorganic.

33. The system according to claim 32, wherein said inorganic material is selected from the group consisting of fiberglass, rock wool, pearlite, mineral wool, and asbestos and mixtures thereof.

34. The system according to claim 31, wherein said supply of material having discrete elements is organic.

35. The system according to claim 34, wherein said organic material is a natural material.

36. The system according to claim 35, wherein said natural material is cellulosic.

37. The system according to claim 21, wherein said supply of material having discrete elements is a non-conductive material.

38. The system according to claim 37, wherein said supply of non-conductive material is a thermally non-conductive material.

39. The system according to claim 37, wherein said supply of non-conductive material is an acoustically non-conductive material.

40. The system according to claim 37, wherein said supply of non-conductive material is an electrically non-conductive material.

41. The system according to claim 21, wherein said integrated electrical system includes an electrical panel and at least one electrical breaker.

42. The system according to claim 41, wherein said integrated electrical system further includes an integrated power cord non-removably attached to said electrical panel.

43. The system according to claim 42, wherein said power cord is a three-prong, single phase connector.

44. The system according to claim 43, wherein said power cord is sized for up to about 20 amps.

45. The system according to claim 21, wherein said inlet for said vented air intake is positioned away from said material feeder for preventing loose supply material from being ingested by said blower unit.

46. The system according to claim 21, further including a crush resistant outlet hose.

47. The system according to claim 46, wherein said crush resistant outlet hose is omni directional.

48. The system according to claim 21, wherein said material feeder further includes a feed hopper for receiving said supply of material having discrete elements.

49. The system according to claim 48, wherein said material feeder further includes a loading station adjacent to said feed hopper.

50. The system according to claim 49, wherein said loading station is a shelf.

51. The system according to claim 50, wherein said shelf further includes a protective stop between said loading station and said feed hopper.

52. The system according to claim 49, wherein said loading station further includes a barrier for preventing items from falling into said feed hopper.

53. The system according to claim 49, wherein said loading station further includes a package slitter for opening said supply of material having discrete elements.

54. The system according to claim 53, wherein said package slitter is a utility knife.

55. The system according to claim 54, wherein said utility knife is a safety utility knife.

56. The system according to claim 53, wherein said package slitter further includes a safety retainer for preventing said package slitter from falling into said feed hopper.

* * * * *